US005129346A

United States Patent [19]

Smith

[11] Patent Number: 5,129,346

[45] Date of Patent: Jul. 14, 1992

[54] RUDDER SLEEVE FOR BOAT RUDDER

[76] Inventor: Gene A. Smith, P.O. Box 179, Shallotte, N.C. 28459

[21] Appl. No.: 741,993

[22] Filed: Aug. 8, 1991

Related U.S. Application Data

[63] Continuation-in-part of Ser. No. 608,007, Nov. 1, 1990, Pat. No. 5,070,803.

[51] Int. Cl.[5] ..... B63H 25/06

[52] U.S. Cl. ..... 114/162; 114/164; 114/168; 440/51

[58] Field of Search ..... 114/162, 163, 164, 165, 114/167, 168, 169, 274, 145 A, 146; 441/79; 440/51, 66

[56] References Cited

U.S. PATENT DOCUMENTS

| | | | |
|---|---|---|---|
| 42,494 | 4/1864 | Lewis | 114/167 |
| 99,639 | 2/1870 | Coleman | 114/162 |
| 142,367 | 9/1873 | Baptista | 114/167 |
| 2,316,022 | 4/1943 | Rippingille | 114/162 |
| 2,990,889 | 7/1961 | Welch | 114/145 A |
| 3,001,502 | 9/1961 | Stoker | 114/167 |
| 4,205,618 | 6/1980 | Olsson | 440/66 |
| 4,304,557 | 12/1981 | Henrich | 440/66 |
| 4,944,202 | 7/1990 | Cain | 440/51 |
| 5,007,868 | 4/1991 | Fry | 441/79 |
| 5,007,869 | 4/1991 | Zoellner | 114/274 |

*Primary Examiner*—Sherman Basinger
*Assistant Examiner*—Thomas J. Brahan
*Attorney, Agent, or Firm*—W. Thad Adams, III

[57] ABSTRACT

A rudder sleeve for enlarging the surface area of a boat rudder includes first and second stainless steel plates having four side edges defining first and second opposed major hydrodynamic surfaces. The rudder sleeve has a substantially rectilinear periphery. The first and second plates are secured together around the periphery of three of the four side edges by welding to define a narrow pocket between the first and second plates enclosed on three side edges.

An open side edge is provided for placing the boat rudder into the pocket. Fastening bolts are provided for being extended through the first and second plates and the boat rudder from side-to-side to fasten the rudder sleeve to the boat rudder.

18 Claims, 3 Drawing Sheets

RUDDER SLEEVE FOR BOAT RUDDER

TECHNICAL FIELD AND BACKGROUND OF THE INVENTION

This invention is a continuation-in-part of applicant's U.S. patent application Ser. No. 07/608,007, filed on Nov. 1, 1990 now U.S. Pat. No. 5,070,80.

This invention relates to a rudder sleeve for a boat rudder, particularly for rudders of large boats such as yachts, commercial fishing craft, and the like. It has been observed that greatly increased control at all speeds by increasing the hydrodynamic surface area exposed to the flow of water. Heretofore rudders have been replaced with larger, much more expensive rudders, requiring substantial expense and downtime.

The invention permits a simple and quick attachment to the rudder which serves as efficiently as complete rudder replacements which are far more expensive. Furthermore, the original rudder is protected within the new sleeve, so that damage to the sleeve can often be repaired, or the rudder sleeve replaced, so that replacement of the original rudder is avoided.

SUMMARY OF THE INVENTION

Therefore, it is an object of the invention to provide a rudder sleeve for being secured in position over an existing boat rudder.

It is another object of the invention to provide a rudder sleeve which slips over and encloses the hydrodynamic surface of the boat rudder.

It is another object of the invention to provide a rudder sleeve which prevents damage to the boat rudder.

It is another object of the invention to provide a rudder sleeve which can be replaced if damaged without replacement of the boat rudder.

It is another object of the invention to provide a rudder sleeve which provides increased hydrodynamic efficiency to the boat rudder.

These and other objects of the present invention are achieved in the preferred embodiments disclosed below by providing a rudder sleeve for enlarging the surface area of a boat rudder and comprising first and second plates having four side edges and defining first and second opposed major hydrodynamic surfaces.

The first and second plates are secured together around the periphery of three of the four side edges to define a narrow pocket between the first and second plates enclosed on three side edges. An open side edge is provided for placing the boat rudder into the pocket. Fastening means are provided for securing the sleeve to the boat rudder.

According to one preferred embodiment of the invention, the first and second plates comprise stainless steel.

According to another preferred embodiment of the invention, the stainless steel plates are secured together by welding.

According to yet another preferred embodiment of the invention, the rudder sleeve includes a zinc sacrificial anode.

According to one preferred embodiment of the invention, the first and second plates are fabricated from a high strength plastic material.

According to another preferred embodiment of the invention, the hydrodynamic surfaces of the rudder sleeve have at least twice the effective surface area of the boat rudder.

Preferably, the rudder sleeve is substantially rectilinear.

According to one preferred embodiment of the invention, the fastening means comprise bolts extended through the first and second plates and the boat rudder from side-to-side.

According to one preferred embodiment of the invention a rudder sleeve is provided for enlarging the surface area of a boat rudder and comprising first and second stainless steel plates having four side edges defining first and second opposed major hydrodynamic surfaces. The rudder sleeve has a substantially rectilinear periphery. The first and second plates are secured together around the periphery of three of the four side edges by welding to define a narrow pocket between the first and second plates enclosed on three side edges.

An open side edge is provided for placing the boat rudder into the pocket. Fastening bolts are provided for being extended through the first and second plates and the boat rudder from side-to-side to fasten the rudder sleeve to the boat rudder.

According to yet another preferred embodiment of the invention, the features of the invention described above are combined with a rudder to form a rudder assembly.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
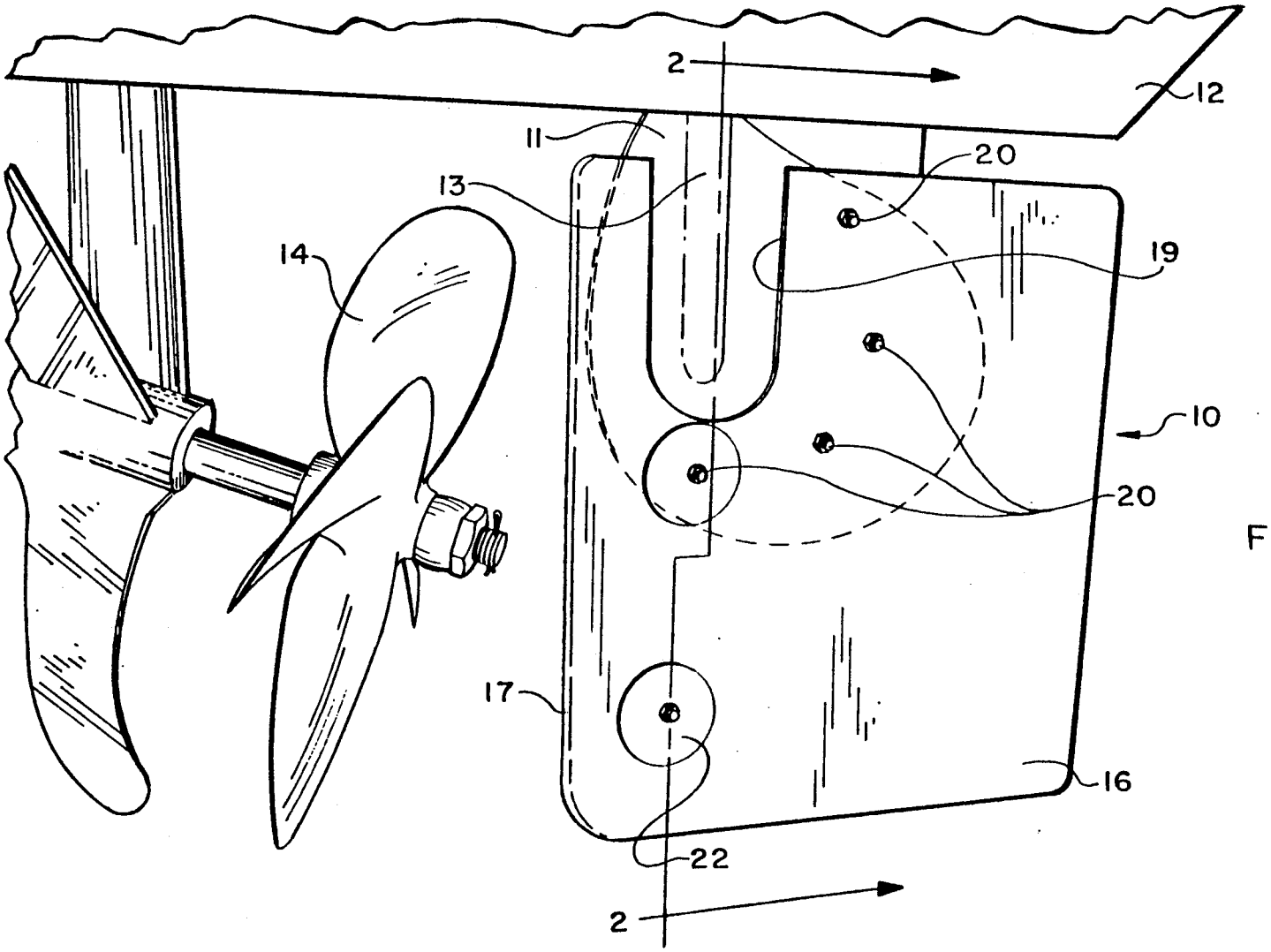
FIG. 1 is a perspective view of a rudder sleeve installation on a conventional boat rudder.

Referring now specifically to the drawings, a rudder sleeve according to the present invention is illustrated in FIG. 1 and shown generally at reference numeral 10. Rudder sleeve 10 is installed on a conventional rudder 11 mounted on the underside of a boat stern 12. Rudder 11 is mounted to a rudder stock 13, which in turn is operated by the wheel of the boat in the cabin or wheelhouse. As is shown in FIG. 1, rudder 11 is mounted for operation directly astern a propeller 14 which propels a propwash rearwardly towards and past the rudder 11.

The rudder 11 shown in the drawings is only one particular type of rudder. Other shapes, including those which are substantially rectangular, are common and are equally useable in combination with the invention disclosed in this application.

Rudder sleeve 10 according to one embodiment of the invention is constructed of two plates of ⅛th inch stainless steel 15, 16, the edges of which are first bent inwardly and then welded together by a weld bead 17 around three side edges—front, rear and bottom. In the embodiment shown in FIG. 1, rudder sleeve 10 is approximately rectangular, being 16 inches from front to back, and 18 inches from top to bottom. The rudder sleeve 10 may be formed in other shapes as well, including more rounded shapes which mimic the original shape of the original rudder.

The bent edges of the plates 15, 16 define a narrow pocket approximately ½ inch wide between them when welded together, into which the rudder is positioned. The surface area of the hydrodynamic surfaces of the rudder assembly thus formed is at least twice the surface area of the original rudder.

Figure 2:
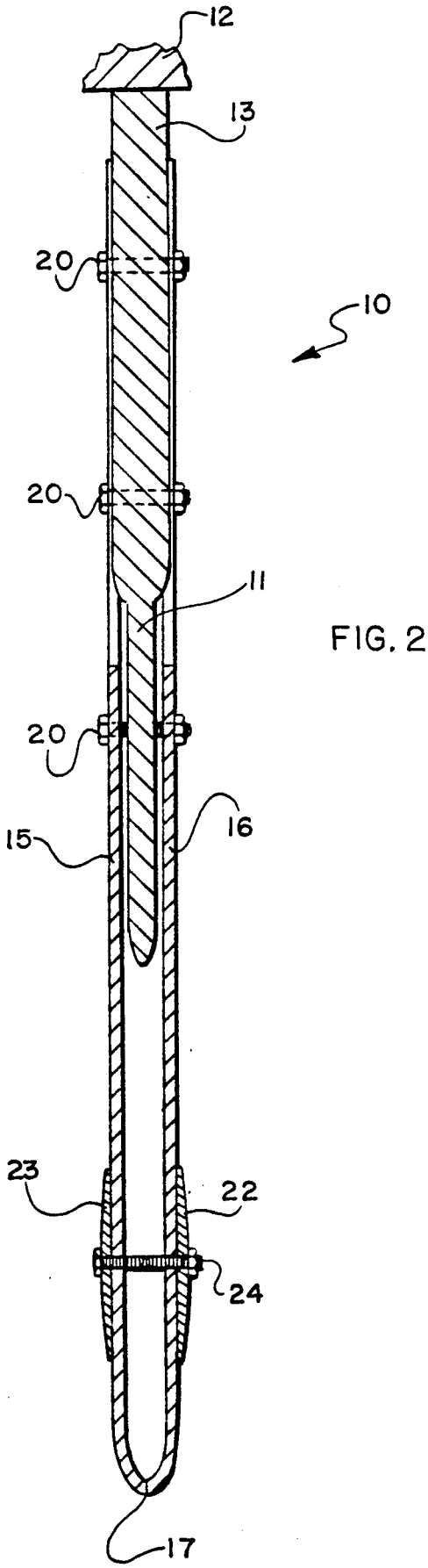
FIG. 2 is a cross-sectional view taken substantially along lines 2—2 of FIG. 1.
Figure 3:
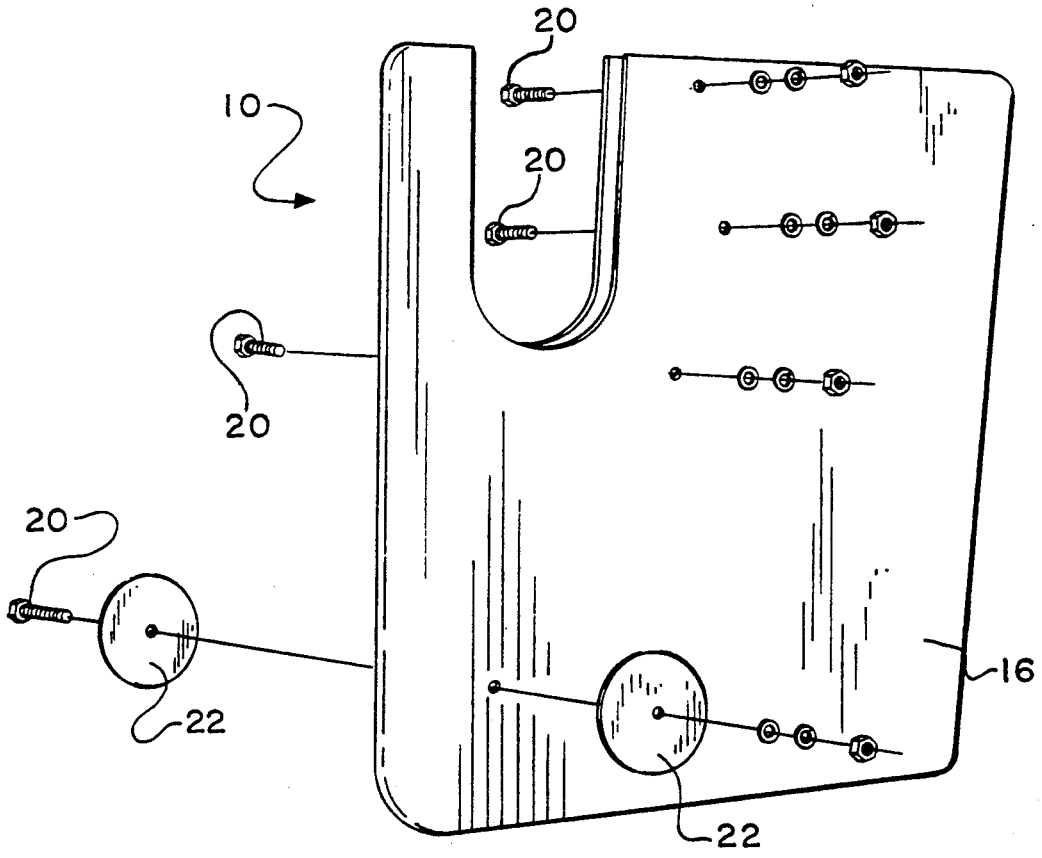
FIG. 3 is an exploded view of an installation of an rudder sleeve.

As is shown in FIGS. 1, 2 and 3, rudder sleeve 10 includes a cut-out area 19 which prevents interference with the rudder stock 13. Rudder sleeve 10 is attached to rudder 11 by bolts 20, which extend through holes drilled completely through both plates 15, 16 and through rudder 11.

Metal discs 22 and 23 of a sacrificial metal such as zinc are attached to the rudder sleeve by a bolt 24 to reduce corrosion resulting from exposure to seawater. Use of such discs on rudders is conventional.

In accordance with another embodiment of the invention, the plates 15, 16 are fabricated from a high strength plastic material such as, for example, a high-strength structural plastic known by the trademark "Geloy." Materials such as carbon fiber composite materials or other materials which are substitutable for sheet steel are also suitable. The rudder 11 sandwiched between the rudder sleeve 10 provides additional overflexing. The thickness and profile of the rudder sleeve in a particular application depends, of course, on the particular use requirements and is determined based upon standard techniques for matching material types, strengths and thicknesses to the particular use.

The rudder sleeve according to the several embodiments described in this application provide a relatively lightweight means of substantially increasing the effectiveness of the rudder without replacing the rudder itself and the attachments of the rudder to the steering gear. The original rudder provides additional strength to the assembly. Damage caused by impact which damages only the rudder sleeve can be easily and quickly repaired by replacing the rudder sleeve. It is believed that in many instances, damage to the gas rudder and the steering gear may be minimized, the rudder sleeve absorbing the brunt of the impact.

A rudder sleeve is described above. Various details of the invention ma be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A rudder sleeve for enlarging the surface area of a boat rudder and comprising:

(a) first and second planar plates having four side edges and defining first and second opposed major hydrodynamic surfaces said plates having a substantially larger hydrodynamic surface area than the boat rudder;

(b) said first and second plates being secured together around the periphery of three cf said four side edges to define a narrow pocket between said first and second plates enclosed on three side edges;

(c) an open side edge for placing the boat rudder into the pocket; and (d) fastening means for fixedly securing said sleeve to the boat rudder.

2. A rudder sleeve according to claim 1, wherein said first and second plates comprise stainless steel.

3. A rudder sleeve according to claim 2, wherein said stainless steel plates are secured together by welding.

4. A rudder sleeve according to claim 2, and including a zinc sacrificial anode.

5. A rudder sleeve according to claim 1, wherein said first and second plates comprise a high strength plastic material.

6. A rudder sleeve according to claim 1, wherein the hydrodynamic surfaces of said rudder sleeve have at least twice the effective surface area of the boat rudder.

7. A rudder sleeve according to claim 1, wherein the rudder sleeve is substantially rectilinear.

8. A rudder sleeve according to claim 1, wherein said fastening means comprise bolts extended through said first and second plates and said boat rudder from side-to-side.

9. A rudder sleeve for enlarging the surface area of a boat rudder and comprising:

(a) first and second stainless steel planar plates having four side edges defining first and second opposed major hydrodynamic surfaces, and having a substantially rectilinear periphery said plates having a substantially larger hydrodynamic surface area than the boat rudder;

(b) said first and second plates being secured together around the periphery of three of said four side edges by welding to define a narrow pocket between said first and second plates enclosed on three side edges;

(c) an open side edge for placing the boat rudder into the pocket; and (d) fastening bolts for being extended through said first and second plates and said boat rudder from side-to-side to fasten said rudder sleeve to the boat rudder.

10. A rudder assembly for a boat comprising:

(a) a boat rudder operatively connected to a steering gear of a boat;

(b) a rudder sleeve for enlarging the surface area of the rudder and comprising:

(i) first and second planar plates having four side edges and defining first and second opposed major hydrodynamic surfaces said plates having a substantially larger hydrodynamic surface area than the boat rudder;

(ii) said first and second plates being secured together around the periphery of three of said four side edges to define a narrow pocket between said first and second plates enclosed on three side edges;

(iii) an open side edge communicating with the pocket and into which the boat rudder is positioned; and (iv) fastening means securing said sleeve to the boat rudder.

11. A rudder assembly according to claim 10, wherein said first and second plates comprise stainless steel.

12. A rudder assembly according to claim 11, wherein said stainless steel plates are secured together by welding.

13. A rudder assembly according to claim 11, and including a zinc sacrificial disc.

14. A rudder assembly according to claim 10, wherein said first and second plates comprise a high strength plastic material.

15. A rudder assembly according to claim 10, wherein the hydrodynamic surfaces of said rudder sleeve have at least twice the effective surface area of the boat rudder.

16. A rudder assembly according to claim 10, wherein the rudder sleeve is substantially rectilinear.

17. A rudder assembly according to claim 10, wherein said fastening means comprise bolts extended through said first and second plates and said boat rudder from side-to-side.

18. A rudder assembly for enlarging the surface area of a boat rudder and comprising:

(a) a boat rudder operatively connected to steering gear of a boat;

(b) a rudder sleeve for enlarging the surface area of the rudder and comprising:

(i) first and second planar plates having four side edges and defining first and second opposed major hydrodynamic surfaces, said first and second planar plates being secured together around the periphery of three of said four side edges by welding to define a narrow pocket between said first and second plates enclosed on three side edges said plates having a substantially larger hydrodynamic surface area than the boat rudder;

(ii) an open side edge communicating with said pocket and into which the boat rudder is positioned; and (iii) fastening bolts extended through said first and second plates and said boat rudder from side-to-side to fasten said rudder sleeve to the boat rudder.

* * * * *